US008813534B2

(12) United States Patent
Barr

(10) Patent No.: US 8,813,534 B2
(45) Date of Patent: Aug. 26, 2014

(54) METHOD FOR REMOVAL OF DENTS FROM WIND TURBINE MASTS

(75) Inventor: Hugh C. Barr, Brownwood, TX (US)

(73) Assignee: Barr Fabrication, Brownwood, TX (US)

( * ) Notice: Subject to any disclaimer, the term of this patent is extended or adjusted under 35 U.S.C. 154(b) by 0 days.

(21) Appl. No.: 13/586,857

(22) Filed: Aug. 15, 2012

(65) Prior Publication Data

US 2012/0304434 A1 Dec. 6, 2012

Related U.S. Application Data

(62) Division of application No. 12/784,120, filed on May 20, 2010, now Pat. No. 8,245,558.

(60) Provisional application No. 61/216,748, filed on May 21, 2009, provisional application No. 61/253,236, filed on Oct. 20, 2009.

(51) Int. Cl.
*B21C 25/02* (2006.01)
*B21D 1/08* (2006.01)

(52) U.S. Cl.
CPC . *B21D 1/08* (2013.01); *Y10S 72/705* (2013.01)
USPC ..... 72/370.04; 72/705

(58) Field of Classification Search
USPC ..... 72/370.04, 705, 392, 457, 481.2
See application file for complete search history.

(56) References Cited

U.S. PATENT DOCUMENTS

| | | | | | |
|---|---|---|---|---|---|
| 1,033,687 | A | * | 7/1912 | Fish | 72/392 |
| 1,837,690 | A | | 12/1931 | Sunde | |
| 2,687,763 | A | * | 8/1954 | Perkins | 72/392 |
| 2,916,076 | A | * | 12/1959 | Young | 72/392 |
| 3,625,046 | A | | 12/1971 | Van Gompel | |
| 4,004,444 | A | * | 1/1977 | Pollart | 72/370.08 |
| 4,555,926 | A | | 12/1985 | Bieli-Moschlin | |
| 4,803,881 | A | | 2/1989 | Dudley | |
| 5,826,457 | A | * | 10/1998 | Eagles | 72/392 |
| 6,000,260 | A | | 12/1999 | Price | |
| 7,246,991 | B2 | | 7/2007 | Bosche | |
| 8,245,558 | B2 | * | 8/2012 | Barr | 72/392 |

* cited by examiner

*Primary Examiner* — Faye Francis
(74) *Attorney, Agent, or Firm* — Strasburger & Price, LLP

(57) ABSTRACT

A method for removal of dents from wind turbine masts uses a dent pushing tool. The dent pushing tool includes a self aligning ram assembly with a central ram cylinder and removable adjustable length arms. At the end of one arm is a curved base. At the end of the other arm is a dent pusher plate. Removal of the dent is caused by extension of the central ram cylinder.

3 Claims, 2 Drawing Sheets

METHOD FOR REMOVAL OF DENTS FROM WIND TURBINE MASTS

CROSS REFERENCE TO RELATED APPLICATIONS

This divisional application claims the benefit of non-provisional U.S. patent application Ser. No. 12/784,120, filed May 20, 2010, issued on Aug. 21, 2012, under U.S. Pat. No. 8,245,558, that claims the benefit of Provisional U.S. patent application No. 61/216,748 filed on May 21, 2009 and Provisional U.S. patent application No. 61/253,236 filed on Oct. 20, 2009, which all applications are incorporated by reference in their entity for all purposes.

STATEMENT REGARDING FEDERALLY FUNDED RESEARCH AND DEVELOPMENT

The invention described in this patent application was not the subject of federally sponsored research or development.

FIELD OF INVENTION

The present invention pertains to a system and method for removing dents from a substantially circular hollow metal structural support column in either a vertical or horizontal orientation. More particularly, the present invention is described according to its use in removing dents from the masts used to support wind turbine driven electrical energy generators.

BACKGROUND

Those traveling in the Western part of the United States have noticed the growing presence of wind towers for providing renewable energy to generate electricity. These wind towers have several large blades which are turned by wind energy. The large blade assembly turns an electrical generator or an alternator and thereby converts wind energy into electrical energy. Supporting the large blade assembly above the ground is typically a substantially circular single hollow metal structural support column or mast.

The rapid growth of the use and construction of wind towers to harness the energy of the wind and convert the energy of the wind into electrical energy is well known. Not so well known is that the walls of the large hollow metal masts which both support and position the rotating blades in the wind are subject to damage. Such damage may occur in many ways such as: blade strikes; transportation damage; construction damage; inadvertent collision with other equipment such as a truck or a crane; and other types of unforeseen damage. Typically, the damage is in the form of a dent in the mast wall. Operators of wind towers have found that when dents in the walls of the masts of wind towers occur, it is generally advisable to remove the dent to assure the structural integrity of the mast as opposed to replacing the entire mast.

Because of the large size of the wind tower masts and the location of the dent on the wind tower mast, removal of a dent from the wall of a wind tower mast is not an easy thing to do. This task is further complicated by the fact that no two dents are exactly the same. Specifically, dents have a unique size, shape, orientation and location with respect to the wind tower mast. Because of the complexity of removing a dent from a wind tower mast there is a need in the art for a system and method for consistently and accurately removing dents from the walls of wind tower masts.

SUMMARY

A system and method for consistently and accurately removing dents from the walls of wind tower masts is disclosed herein.

The disclosed system and method is enabled by a dent pushing tool. The dent pushing tool includes a self aligning ram assembly. The self aligning ram assembly includes a central air over hydraulic or electric over hydraulic central ram cylinder. Extending outwardly from the central ram cylinder are removable first and second adjustable length arms. The lengths of the first and/or second arms are adjusted by the use of inserts placed either within or at the ends of the arms. Attached to the outboard end of the first adjustable length arm is a curved base. Attached to the outboard end of the second adjustable length arm is a pusher plate.

Use of the dent pusher to properly remove a dent from the wall of a wind turbine mast begins by assessing the size of the dent and formulating a plan for its removal. Once the plan for removal of the dent has been formulated, the dent pushing tool is put in place within the hollow portion of the wind turbine mast. The pusher plate is placed against the dent. The curved base is placed against the wall of the wind turbine mast opposite from the dent. The self aligning ram assembly and the extension arms are located to lie along an internal diameter of the wind turbine mast. The adjustable length extension arms are sized by the use of inserts to be a sufficient length to hold the dent pushing tool in place within the interior of the wind turbine mast.

With the dent pusher tool in place within the wind turbine mast, the process of removing the dent from the wall of the wind turbine mast begins. Dent removal begins at a predetermined end of the dent. The central ram cylinder portion of the self aligning ram assembly is extended so that the dent is pushed outwardly toward the external wall of the wind turbine mast. The force from the central ram cylinder is monitored by the use of a pressure gauge. As the dent starts to come out of the wall of the wind turbine mast, the dent pushing tool is relocated to another location along the dent so that the pusher plate is effectively walked along the dent until the dent is removed. After each application of force against the dent, the size and orientation of the dent is re-assessed to assure that the dent is reacting as predicted to the applied force. The condition of the dented metal is monitored closely with non-destructive metal testing techniques as the dent is pushed out. Removal of the dent is assured by measuring the area where the dent was located to assure that the dent has been completely removed. In certain circumstances progress toward removal of the dent is assured by taking pictures of the dent of each step during the dent removal process.

BRIEF DESCRIPTION OF THE DRAWING FIGURES

A better understanding of the system and method for the removal of dents from wind turbine masts may be had by reference to the drawing figures wherein.

DESCRIPTION OF THE EMBODIMENTS

Figure 1:
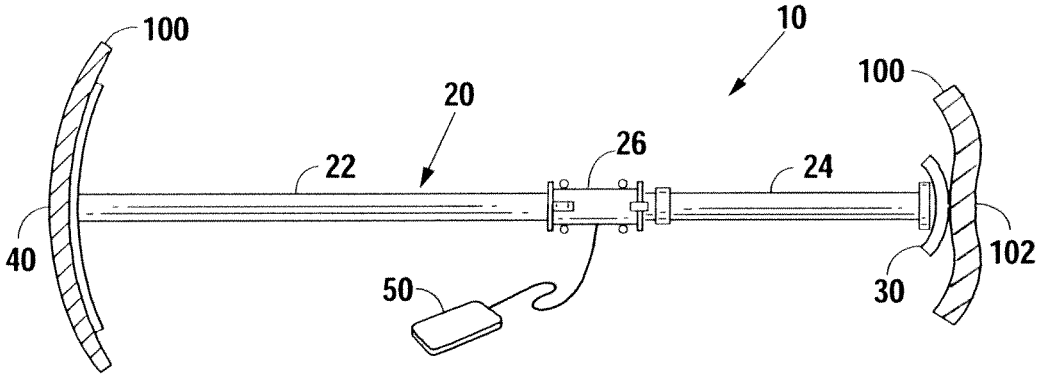
FIG. 1 is a plan view of the dent removal tool placed within a wind turbine mast having a dent in a side wall.
Figure 2:
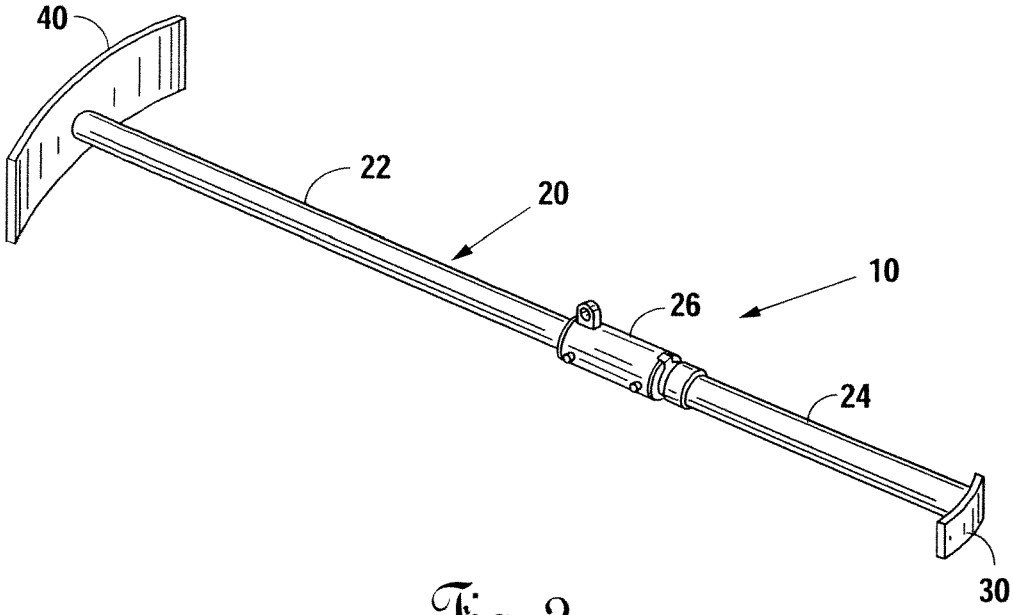
FIG. 2 is a perspective view of the dent removal tool.
Figure 3:
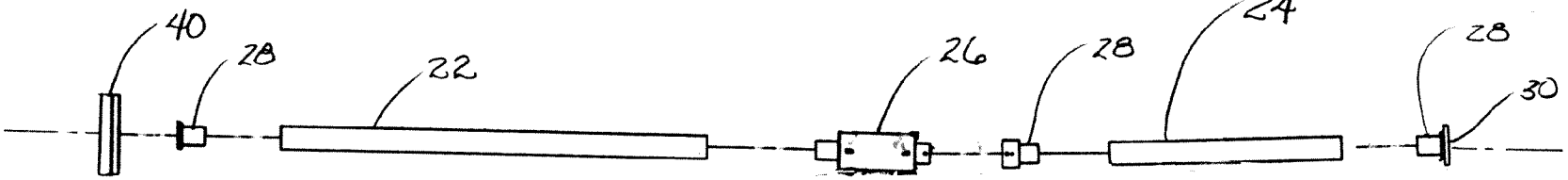
FIG. 3 is an exploded elevational view of the dent removal tool.

As may be seen in the drawing figures the system and method of the present invention is enabled by a dent pushing tool 10. The dent pushing tool 10 is an elongated self-aligning ram assembly 20. This elongated self-aligning ram assembly 20 is sized to fit with the diameter of the hollow metal structural support column by adjusting the length of the pipe sections 22, 24 which extend from the central ram or actuating cylinder 26 between the two ends of the self-aligning ram assembly 20. This length adjustment is accomplished by the use of inserts 28 placed either within or at the ends of the pipe sections 22, 24. To assure maximum surface contact with the inserts 28, the contact surfaces of the inserts are machined as are the surfaces with which the inserts 28 come into contact.

The force applied by the self-aligning ram assembly 20 is obtained from a central ram cylinder 26 which is either an air over hydraulic or an electric over hydraulic cylinder between the ends of the self-aligning ram assembly. Such air over hydraulic or electric over hydraulic cylinders are sold under the EMPAC brand and are well know by those of ordinary skill in the art. In actual use, it has been found that if the disclosed self-aligning ram assembly 20 is able to exert up to about 50 tons of force against a dent 102 in the wall 100 of a hollow metal structural support column most dents can be pushed out. The actual amount of force needed to remove a dent is determined by the size, the orientation, the location, and the shape of the dent. During the dent removal process, the amount of force being placed on the dent is monitored by one or more pressure gauges connected to the central ram cylinder 26.

Various different types and shapes of dent pushing plates 30 may be used against the inside of the dent depending on the size and orientation of the dent. Typically, the dent is "walked out"; that is, the dent is pushed out in small steps from one end of the dent to the other until the dent has been completely removed.

On the opposite end of the ram from the dent is an arcuate support or curved base 40. The arcuate support or curved base 40 provides a broad foundation for support of the self aligning ram assembly and assists in assuring that the self-aligning ram assembly is properly lined up along the diameter of the hollow metal structural support column. In the preferred embodiment, the arcuate support or curved base 40 is made from a one inch thick aluminum section. The softness of the aluminum as compared to the rigidity of the steel used construct the wind tower mast enables the aluminum to flex to the shape of the interior wall of the mast.

The purpose of the disclosed procedure is to minimize the distortion of the hollow metal support mast portion 100 of a wind tower. As indicated above, the dent pushing tool 10 described therein includes an arcuate support or curved base 40. The curved base section 40 is used to disperse the force applied to the dent on the opposite side of the hollow mast 100 from the dent 102.

On the other end of the dent pushing tool 10 from the arcuate support or curved base 40 is the dent pusher plate 30. The dent pusher plate 30 concentrates the forces on the dent 102 by the use of a pusher plate 30. The pusher plate 30 is both shaped and positioned to align the force applied by the dent pushing tool 10 either on the apex or apexes of the dent or at some other point on the dent to be removed from the wall of the wind tower mast. As previously indicated, the wind tower mast may be on the ground if a dent is to be removed before the wind tower is erected. In other situations, the wind tower mast may be vertical. When the wind tower mast is vertical, the dent pushing tool 10 is rigged and lifted upwardly within the mast to the level of the dent.

Because of the sensitivity of the removal of dents from the walls of the hollow masts of wind towers, those who use actually remove the dents from the walls of wind tower masts receive at least 40 hours of classroom and practical instruction on dent removal and use of the dent pushing tool. Following the completion of the instruction those using the dent pushing tool 10 are tested and certified. Thus, before any job is undertaken to remove a dent from a wind tower mast, a check is made to assure that all personnel have been certified in the use of the dent pushing tool 10 and the procedures for dent removal.

Wind towers are located in may diverse locations. Each location has its own physical characteristics and operating procedures. Further, each location has its own safety procedures. When certified dent removal technicians arrive at the site where their dent removal expertise is required, the certified dent removal technicians are given a site orientation and a safety briefing.

Following the site orientation and the safety briefing a Job Safety Analysis is initiated during the review of the actual damage to the hollow mast portion of the wind tower. This Job Safety Analysis is documented in writing and a copy is provided to the on-site safety personnel.

Before any work starts on the removal of the dent from the wall of the hollow mast portion of the wind tower, the dent is thoroughly inspected and measured with lasers, levels, straight edges, calipers, etc. to determine the depth and configuration of the dent to be removed.

Pictures may be taken of the damaged area of the wind tower mast during the initial inspection to thoroughly document the "before" condition of the dent as well as the dimensions of the dent.

Once the dent has been measured and photographed, the dent pushing tool as described above is moved into the interior of the hollow mast for assembly and proper positioning. As will be understood by those of ordinary skill in the art, any misalignment of the dent pushing tool within the hollow mast could create either an unsafe condition or could cause additional damage to the mast wall.

Before the dent pushing end of the dent pushing tool is placed against the dent, a further evaluation of the dent is made. Such evaluation encompasses all aspects of the damaged area to include: the general direction of the damaged area with respect to the wall of the wind tower mast, the overall size of the damaged area; and the type of damage to the wall of the hollow mast such as sharp edges or creases, shallow rounded deformities, etc.

When the extent of the damage to the wall of the hollow mast is understood, a plan is formulated for removal of the dent. Such plan will include at least the starting point and the ending point of the repair and the points therebetween as most dents generally have to be walked out of the mast wall. It is these critical details that will enable repair of the damaged area of the mast wall without over-pushing the dent to create an external bulge or an out-of-roundness condition on the exterior of the wind tower mast.

Non-destructive testing metal testing techniques may be used during the dent removal process. For example, magnetic particles may be used to either evaluate or watch for surface cracks in either the interior the exterior of the mast wall. Ultrasonic or electromagnetic wave evaluation techniques may also be used to look for internal cracks within the wind tower mast wall. And, strain gauges may be placed on the dent to assure that metal of the mast wall never exceeds its yield strength during the dent removal process. Each step during the dent removal process may be photographed for study. Operation of the dent pushing tool 10 and monitoring of the results of the non-destructive metal evaluation procedures are often accomplished with use of a remote control 50 or at a remote location because of the large forces needed to remove a dent from the wall of a wind tower mast.

Certain dents may require the use of spider bracing within the mast to localize pressure in the dent removal area. Such spider bracing prevents distortion of the hollow mast wall and will maintain the roundness of the hollow mast following the dent removal process.

When a dent or a flat area is being repaired, the wall material is not deformed or stretched. Rather, the wall material is restored to its original contour. Such restoration occurs by the application of force from the dent pushing tool on the damaged area. The effect of the application of force on the dent is continually monitored. No heat is ever used as the grain structure of metal of the mast wall is not to be altered. It has been found, however, that in very cold climates, it may be necessary to warm the area of the dent to reduce brittleness within the metal thereby enabling better control over the dent removal process.

As the application of force causes the size of the dent to be reduced, lasers, levels, straight edges calipers, etc. are applied to the dent to closely monitor the effect of the applied force on the dent. At the same time the mast wall opposite the dent being removed is closely monitored and may be photographed to assure its integrity during the dent removal process.

Once the dent has been removed from the wall of the hollow wind tower mast, pictures of the damaged area may be taken again. The damaged area is remeasured. The measurements, together with the pictures, verify and document the removal of the dent from the wall of the hollow wind tower mast.

Once the dent has been satisfactorily removed from the wind tower mast wall, the dent removal tool is disassembled, removed and transported to another job site.

Before leaving the job site, the crew that repaired the dent completes a report including the before and after dimensions of the dent, the condition of the wind tower mast, the equipment used to remove the dent and any before, during and after pictures.

Those of ordinary skill in the art will also understand that the system and method of the present invention may also be used to repair flat spots or out-of-round conditions in the flanges which appear at the ends of wind tower masts or between sections of wind tower masts. Because of the shape and thickness of these flanges, it may be necessary to create special plate 30 to contact the interior edge of the flange. Because of the unique nature of a flange, extensive measurement of the flange is necessary before a flat spot or out-of-round condition can be repaired. Such measurements may include the diameters of the exterior and interiors of the flange as well as the diameter of the bolt circle. Depending on the thickness of the flange, it has been found that forces up to about 100 tons may be needed to reshape a flange.

While the present invention has been disclosed according to its preferred and alternate embodiments, those of ordinary skill in the art will realize that other embodiments of the disclosed invention may be made and may have utility in other applications. Such embodiments and use in other applications shall be included within the scope and meaning of the appended claims.

What is claimed is:

1. A method for removing a dent from the wall of a substantially circular hollow metal support structural support column, said method comprising the steps of:

evaluating the dent;

formulating a plan for removal of the dent;

placement of a dent pushing tool against the dent, said dent pushing tool including:

a self-aligning, remotely actuatable ram assembly including a central ram and first and second adjustable length arms extending from said central ram;

a curved base attached to the end of said first adjustable length arm, said curved base constructed and arranged for placement on the interior wall of the substantially circular hollow metal structural support column across from the dent; and a dent pusher plate attached to the end of said second adjustable length arm, said pusher late constructed and arranged for placement against the dent on the interior wall of the substantially circular hollow metal structural support column;

aligning said dent pushing tool substantially along an interior diameter of said substantially circular hollow metal structural support column so that said pusher plate is in contact with one end of said dent and said curved base is in contact with the wall interior wall of said substantially circular hollow metal structure across from said dent;

actuating said ram assembly to cause force to be placed on the dent by said pusher plate;

moving said dent pushing tool along the dent from one end to the other and repeating the forgoing procedure until the dent has been removed from the wall of the substantially circular hollow metal structure, wherein said step of evaluating the dent includes determining a direction of the dent, a size of the dent, a depth of the dent, and a type of damage to the wall where the dent is located.

2. A method for removing a dent from the wall of a substantially circular hollow metal support structural support column, said method comprising the steps of:

measuring the size of the dent;

formulating a plan for removal of the dent;

placement of a dent pushing tool against the dent, said dent pushing tool including:

a self-aligning, remotely actuatable ram assembly including a central ram and first and second adjustable length arms extending from said central ram;

a curved base attached to the end of said first adjustable length arm, said curved base constructed and arranged for placement on the interior wall of the substantially circular hollow metal structural support column across from the dent; and a dent pusher plate attached to the end of said second adjustable length arm, said pusher late constructed and arranged for placement against the dent on the interior wall of the substantially circular hollow metal structural support column;

aligning said dent pushing tool substantially along an interior diameter of said substantially circular hollow metal structural support column so that said pusher plate is in contact with one end of said dent and said curved base is in contact with the wall interior wall of said substantially circular hollow metal structure across from said dent;

actuating said ram assembly to cause force to be placed on the dent by said pusher plate;

moving said dent pushing tool along the dent from one end to the other and repeating the forgoing procedure until the dent has been removed from the wall of the substantially circular hollow metal structure, wherein the dent is measured during the dent removal process while a condition of the dent is monitored using one or more non-destructive metal evaluation techniques being selected from a group including surface magnetic particles, ultrasonic testing, electromagnetic wave testing, and strain gauges.

3. The method as defined in claim 2 wherein the plan for removal of the dent is adjusted following each measurement of the dent after each application of force against the dent.

* * * * *